US007530842B1

(12) United States Patent
Hsu

(10) Patent No.: US 7,530,842 B1
(45) Date of Patent: May 12, 2009

(54) HIGH-FREQUENCY CONNECTOR ASSEMBLY

(75) Inventor: Chin-Teng Hsu, Yungkang (TW)

(73) Assignee: Lih Yeu Seng Industries, Co., Ltd., Yungkang (TW)

( * ) Notice: Subject to any disclaimer, the term of this patent is extended or adjusted under 35 U.S.C. 154(b) by 0 days.

(21) Appl. No.: 12/117,883

(22) Filed: May 9, 2008

(51) Int. Cl.
*H01R 9/05* (2006.01)

(52) U.S. Cl. ..... 439/578

(58) Field of Classification Search ..... 439/578, 439/675, 382, 383, 385
See application file for complete search history.

(56) References Cited

U.S. PATENT DOCUMENTS 3,206,540 A * 9/1965 Cohen ..... 174/89
6,234,838 B1 * 5/2001 Wong ..... 439/578
7,347,726 B2 * 3/2008 Wlos ..... 439/578

* cited by examiner

*Primary Examiner*—Tho D Ta
(74) *Attorney, Agent, or Firm*—Alan Kamrath; Kamrath & Associates PA

(57) ABSTRACT

A high-frequency connector assembly includes a first connector having a conductive pin and formed with at least one slit at a receiving periphery thereof for allowing a second connector inlaid with an O-ring to be inserted therein. The pin in the first connecter can be received by a pin holder in the second connector. An expanded section at a rear portion of the second connector is received by an expanded section of the first connector. An annular groove formed adjacent to the expanded section on the second connector pressingly abuts against a contracted edge slope at an end of the receiving periphery of the first connector. The connector assembly facilitates mitigating attrition caused by frequent vibration and provides a damp-proof effect, thereby ensuring a desired transmission efficiency.

7 Claims, 11 Drawing Sheets

HIGH-FREQUENCY CONNECTOR ASSEMBLY

BACKGROUND OF THE INVENTION

1. Technical Field

The present invention relates to a connector assembly applied to communication devices used under highly vibrational operating conditions, such as mobile phones, aircraft or vehicle communication devices, etc., wherein the connector assembly ensures desired transmission efficiency by suppressing external interference and providing a damp-proof effect.

2. Description of Related Art

While various connectors serving diverse communication devices have been developed, a conventional approach for providing two assembled connecting members (as shown in FIG. 1) with a spring clamping connection therebetween involves inserting a terminal block 10, that is embracing a conductive pin 20 and that is formed with a slit 101 at an outer periphery thereof into a receiving hole 301 provided on a matching terminal block 30. Thus, the outer periphery 102 of the terminal block 10 can resiliently press against an annular groove 302 formed inside the receiving hole 301 of the matching terminal block 30 on the strength of the slit 101 while the pin 20 in the terminal block 10 is received in a pin holder 40 in the matching terminal block 30, thereby achieving a desired signal connection between such assembled connecting members.

However, when the terminal block 10 is assembled to the matching terminal block 30, the slit 101 arranged at the outer periphery 102 forms an interval between the terminal block 10 and the receiving hole 301 of the matching terminal block 30. Thus, external air tends to permeate into the assembled connecting members through the slit 101. Consequently, after a period of use, the components in the assembled connecting members may suffer from oxidation and rustiness, and degeneration of transmission efficiency of the connecting members may therefore occur. Meantime, since the slit 101 of the terminal block 10 substantially results in an opened border between the connected pin 20 and pin holder 40, high-frequency output loss of the assembled connecting members can be undesirably increased. Besides, when the slit 101 of the terminal block 10 can only provide the resilient pressing force bias, buffering and shock-absorbing effects of the conventional connector assembly against an external vibration is limited.

Therefore, Beryllium-Copper Alloy has been used in the industry to remedy the aforementioned problems and enhance the transmission efficiency of connector assemblies. However, the high-priced Beryllium-Copper Alloy is a very un-environmental friendly contaminant, and the shock-absorbing effect it provides is not perfect.

SUMMARY OF THE INVENTION

The present invention is thus provided to improve all existing problems related to connectors for various communication devices and propose a high-frequency connector assembly with a high transmission efficiency as well as desired shock-absorbing and damp-proof effects without a need for using Beryllium-Copper Alloy.

A first objective of the present invention is to provide a high-frequency connector assembly. A first connector having a conductive pin therein is formed with at least one slit at a receiving periphery thereof for allowing a second connector having a connecting section inlaid with an O-ring to be inserted therein. The pin in the first connecter can be received by a pin holder in the second connector. An expanded section at a rear portion of the second connector is received by an expanded section of the first connector. An annular groove defined between two slopes adjacent to the expanded section on the second connector pressingly abuts against a contracted edge having a slope at an end of the receiving periphery of the first connector. Thus, in the high-frequency connector assembly of including the first and second connectors, an opened border caused by the slit is formed between the two expanded sections but not between the pin and the pin holder, thereby ensuring a desired transmission efficiency of a device using the high-frequency connector assembly working in highly vibrational operating conditions.

A second objective of the present invention is to provide a high-frequency connector assembly, wherein a nut is combined at an exterior of the high-frequency connector assembly including a first connector and a second connector. Thus, so that when the high-frequency connector assembly is applied to a thick cable or an antenna or used in an environment where an external interfering force exists, firmness of the high-frequency connector assembly can be ensured.

A third objective of the present invention is to provide a high-frequency connector assembly, wherein an adapter is combined with each of a first connector and a second connector. Thus, the high-frequency connector assembly including the first and second connectors can be connected to external components.

A fourth objective of the present invention is to provide a high-frequency connector assembly, wherein a normally contracted flexible raised annulation is formed at an end of a receiving periphery of a first connector for pressingly abutting against and thereby being retained in an annular groove defined between two slopes at a rear end of an expanded section on a second connector. A nut having an inner threaded section can be screwed onto a threaded section of the first connector towards the second connector. Thus, a slanted rim formed at an opening of the nut can pressingly abut against the flexible raised annulation of the first connector, and, in turn, the flexible raised annulation and the annular groove defined between the two slopes on the second connector can be further engaged with and positioned with respect to each other.

BRIEF DESCRIPTION OF THE DRAWINGS

The present invention as well as a preferred mode of use, further objectives and advantages thereof will best be understood by reference to the following detailed description of illustrative embodiments when read in conjunction with the accompanying drawings, wherein.

DETAILED DESCRIPTION OF THE PREFERRED EMBODIMENT

Figure 2:
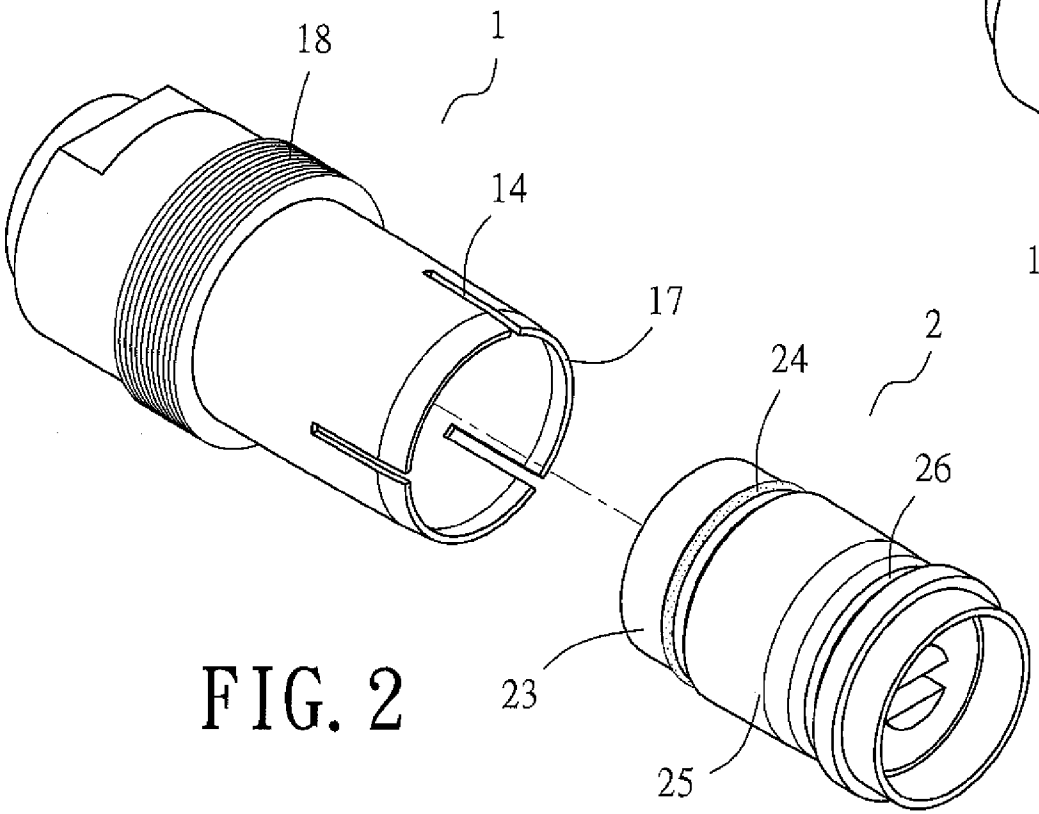
FIG. 2 is an exploded view of a high-frequency connector assembly of the present invention.
Figures 3, 3A, 3B:
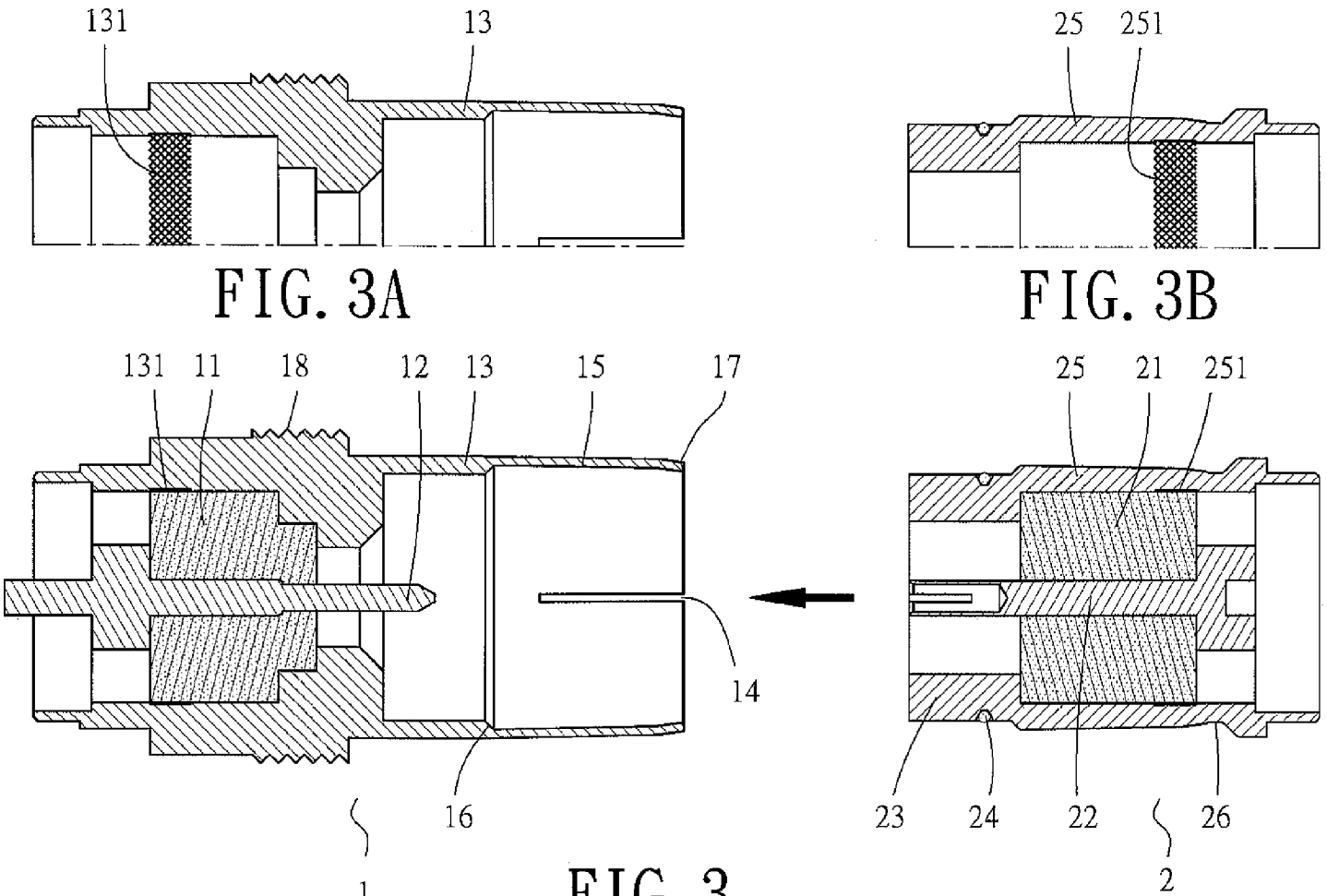
FIG. 3 is an exploded view of the high-frequency connector assembly of the present invention.
FIG. 3A is a partial, sectional view of the first connector of the high-frequency connector assembly of FIG. 3.
FIG. 3B is a partial, sectional view of the second connector of the high-frequency connector assembly of FIG. 3.

Please refer to FIGS. 2 and 3 for a high-frequency connector assembly of the present invention. Therein, a first connector 1 and a second connector 2 are assembled to form the high-frequency connector assembly 3.

The first connector 1 inside is formed with an anti-slip annular section 131 (embodied by inner threads formed along a positive direction and a negative direction according to the present embodiment) for fittingly settling an insulator 11 therein so as to position a conductive pin 12 in the first connector 1. The first connector 1 is further formed with at least one slit 14 at a receiving periphery 13 on a working end thereof. An expanded section 15 having an expanded diameter inside of the first connector 1 faces an opening of the working end. A transitional rim 16 is defined between inner surfaces of the expanded section 15 and the receiving periphery 13. In addition, a contracted edge 17 having one slope is formed at an end of the expanded section. A threaded section 18 is formed at an outer periphery of the first connector 1 near a rear end opposite to the working end of the first connector 1.

The second connector 2 inside is also formed with an anti-slip annular section 251 (embodied by inner threads formed along a positive direction and a negative direction according to the present embodiment) for fittingly settling an insulator 21 therein so as to position a conductive pin holder 22 in the second connector 2. The second connector 2 includes a connecting section 23 which is near a working end of the second connector 2 and which has an outer periphery thereof inlaid by an O-ring 24 (embodied in a flexible ring made of rubber or silicon). The connecting section 23 is followed by an expanded section 25 that has an expanded inner diameter and that includes an outer, annular groove 26 having two slopes near a rear end opposite to the working end of the second connector 2.

Figure 1:
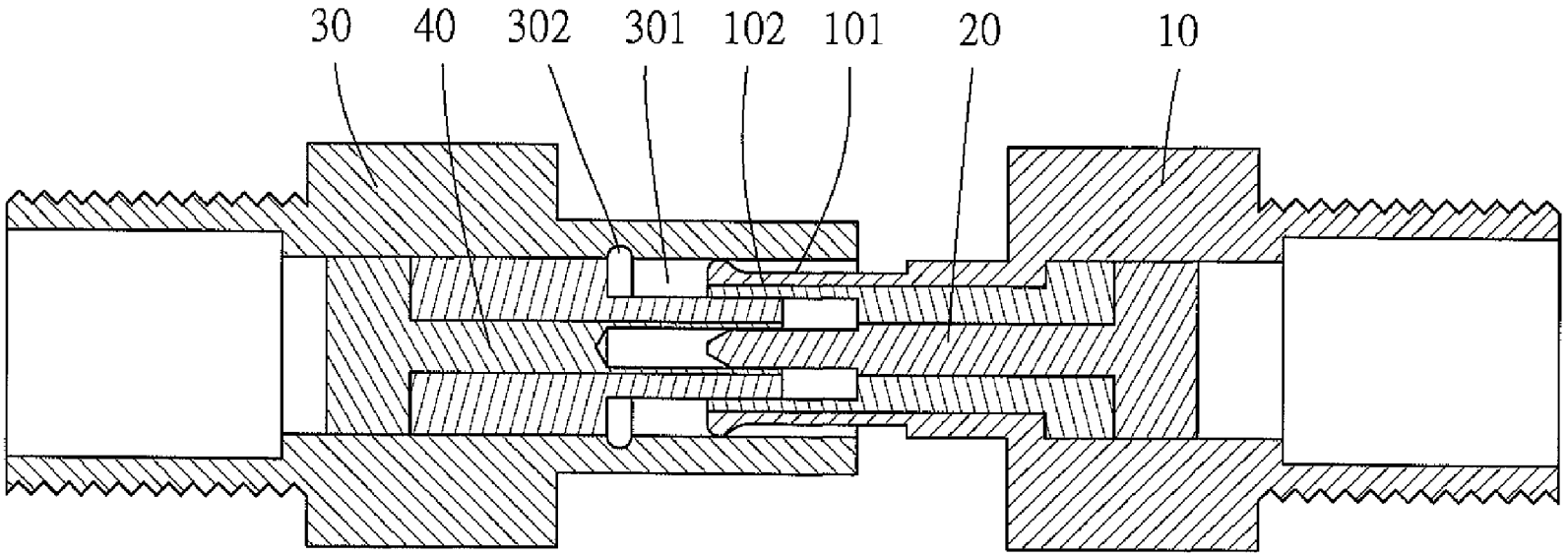
FIG. 1 (Prior Art)
FIG. 1 is a sectional view of a conventional high-frequency connector assembly wherein connectors are assembled.
Figure 6:
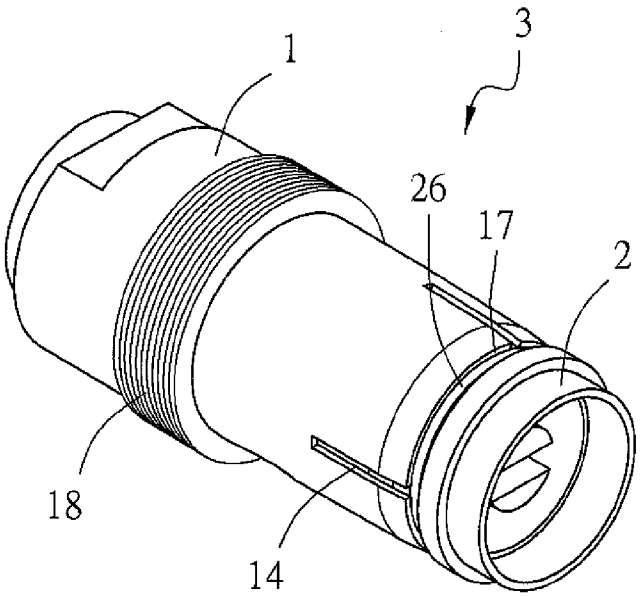
FIG. 6 is a perspective view of the high-frequency connector assembly of the present invention.
Figure 4A:
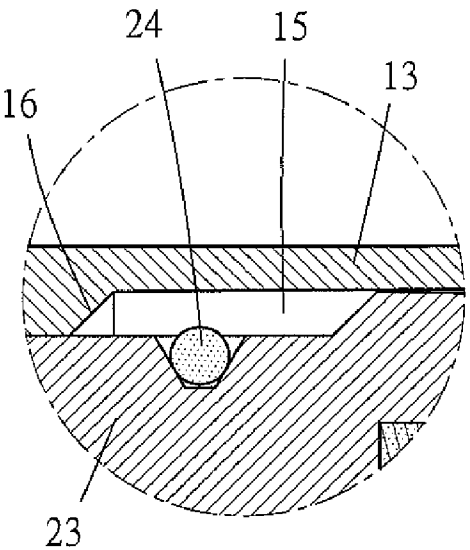
FIG. 4A is an enlarged, sectional view of the encircled area A of the high-frequency connector assembly of FIG. 4.
Figure 4:
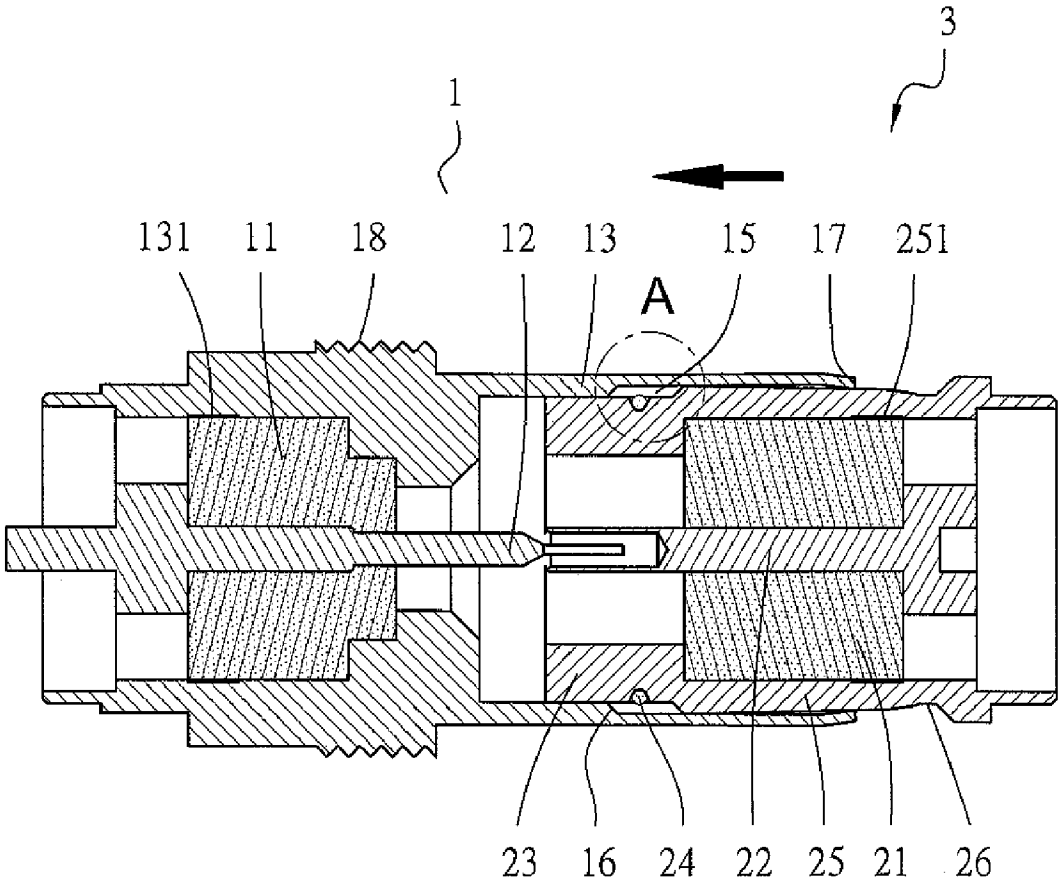
FIG. 4 is an exploded view of the high-frequency connector assembly of the present invention.
Figure 5A:
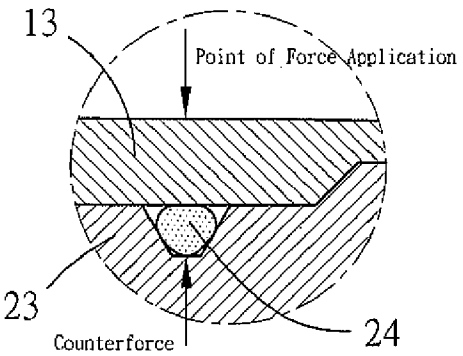
FIG. 5A is an enlarged, sectional view of the encircled area A of the high-frequency connector assembly of FIG. 5.
Figure 5B:
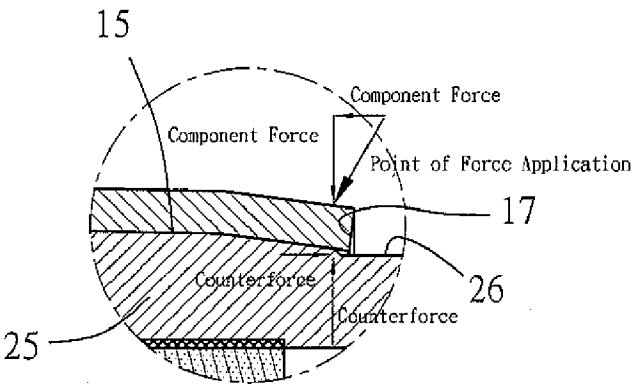
FIG. 5B is an enlarged, sectional view of the encircled area B of the high-frequency connector assembly of FIG. 5.
Figure 5:
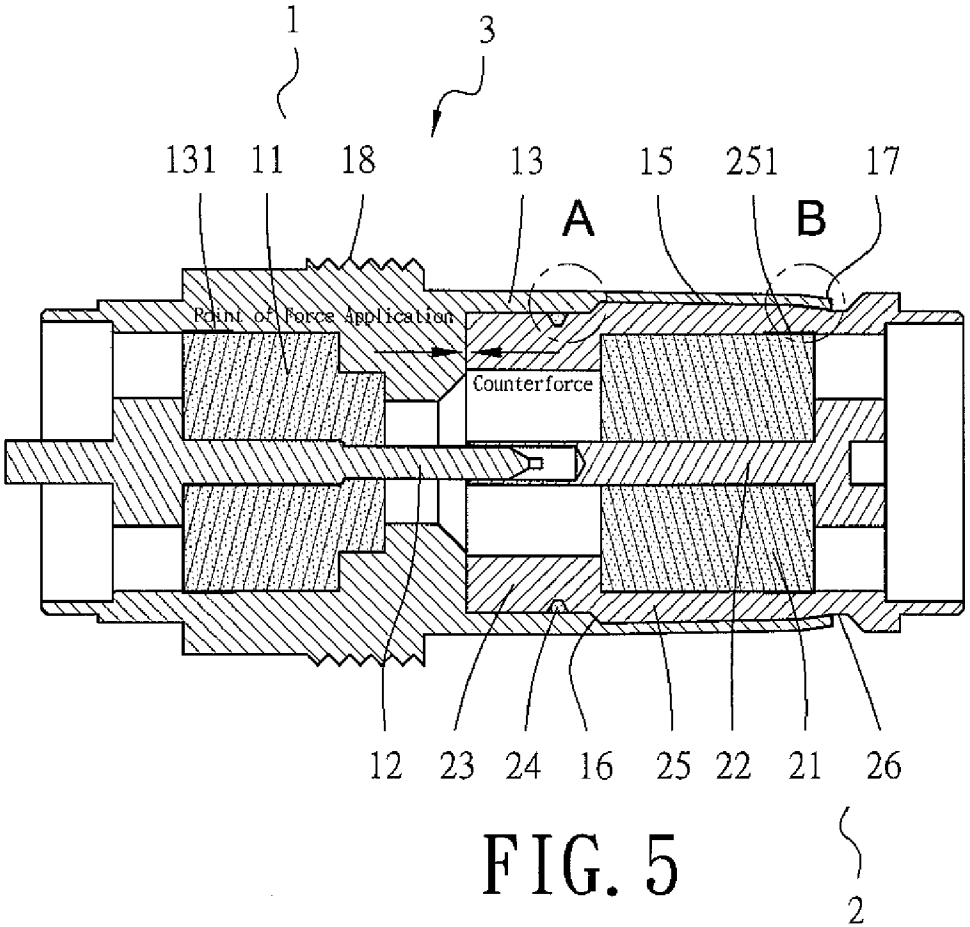
FIG. 5 is a sectional view of the high-frequency connector assembly of the present invention.

For assembling the first and second connectors 1, 2, referring to FIG. 4, the connecting section 23 having the O-ring 24 of the second connector 2 is inserted into the receiving periphery 13 having the slit 14 of the first connector 1. When the O-ring 24 at the connecting section 23 of the second connector 2 contacts the transitional rim 16 adjacent to the end of the expanded section 15 of the first connector 1, (as shown in FIG. 4A and the second connector 2 keeps entering the first connector 1, the O-ring 24 contracts inward under a pressing force from the transitional rim 16 (as shown in FIG. 5A) so that the expanded section 25 having the expanded diameter and following the connecting section 23 of the second connector 2 can smoothly pierce into the expanded section 15 following the receiving periphery 13 of the first connector 1, as shown in FIG. 5. Thus, the O-ring 24 at the connecting section 23 retained in the receiving periphery 13 of the first connector I serves to suppress impact caused by an external vibration and to block external air and humidity from entering the assembled high-frequency connector assembly 3 so as to prevent the conductive pin 12 of the first connector 1 and the conductive pin holder 22 of the second connector 2 from being rust-eaten. On the other hand, when the expanded section 25 at a rear portion of the second connector 2 enters the expanded section 15 of the first connector 1, the contracted edge 17 having the slope formed at the end of the receiving periphery 13 of the first connector 1 can pressingly abut against and thus be engaged with the annular groove 26 defined between the two slopes on the second connector 2 (as shown in FIG. 5B). At this time, a counterforce exerted outward from the annular groove 26 defined between the two slopes on the second connector 2 can counteract vertical and horizontal components generated at the contracted edge 17 having the slope on the first connector 1. Thus, the second connector 2 and the first connector 1 can be stably positioned with respect to each other. It is to be noted that, in another embodiment of the present invention, more than one annular groove defined between the two slopes on the second connector and more than one contracted edge having the slope on the first connector may be implement according to needs in practice. Thereby, the high-frequency connector assembly 3 including the first connector 1 and the second connector 2 (as shown in FIG. 6) can provide desired transmission efficiency when applied to communication devices used under highly vibrational operating conditions.

Figure 7:
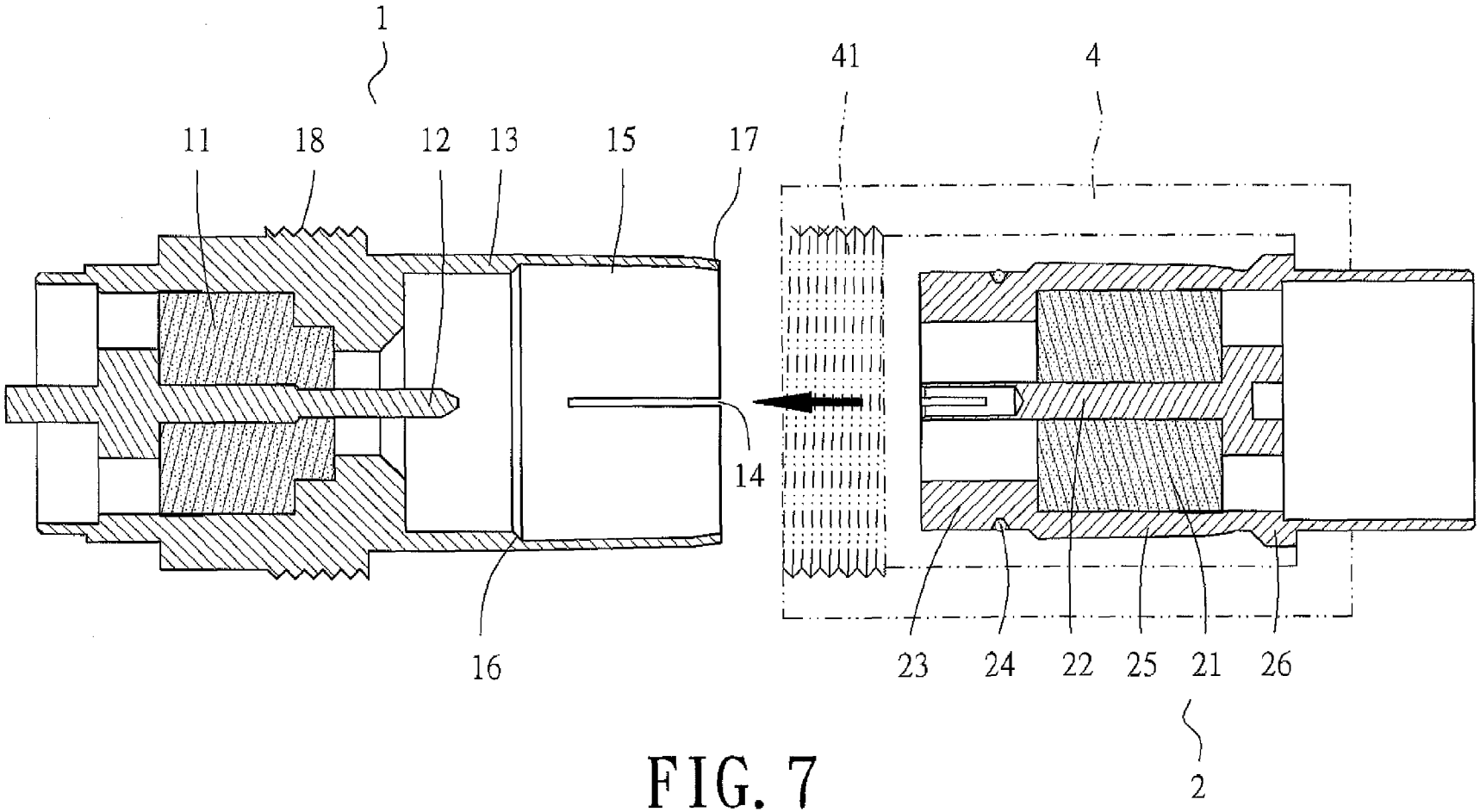
FIG. 7 is a sectional view of the high-frequency connector assembly of the present invention, wherein the second connector is combined with a nut.
Figure 8:
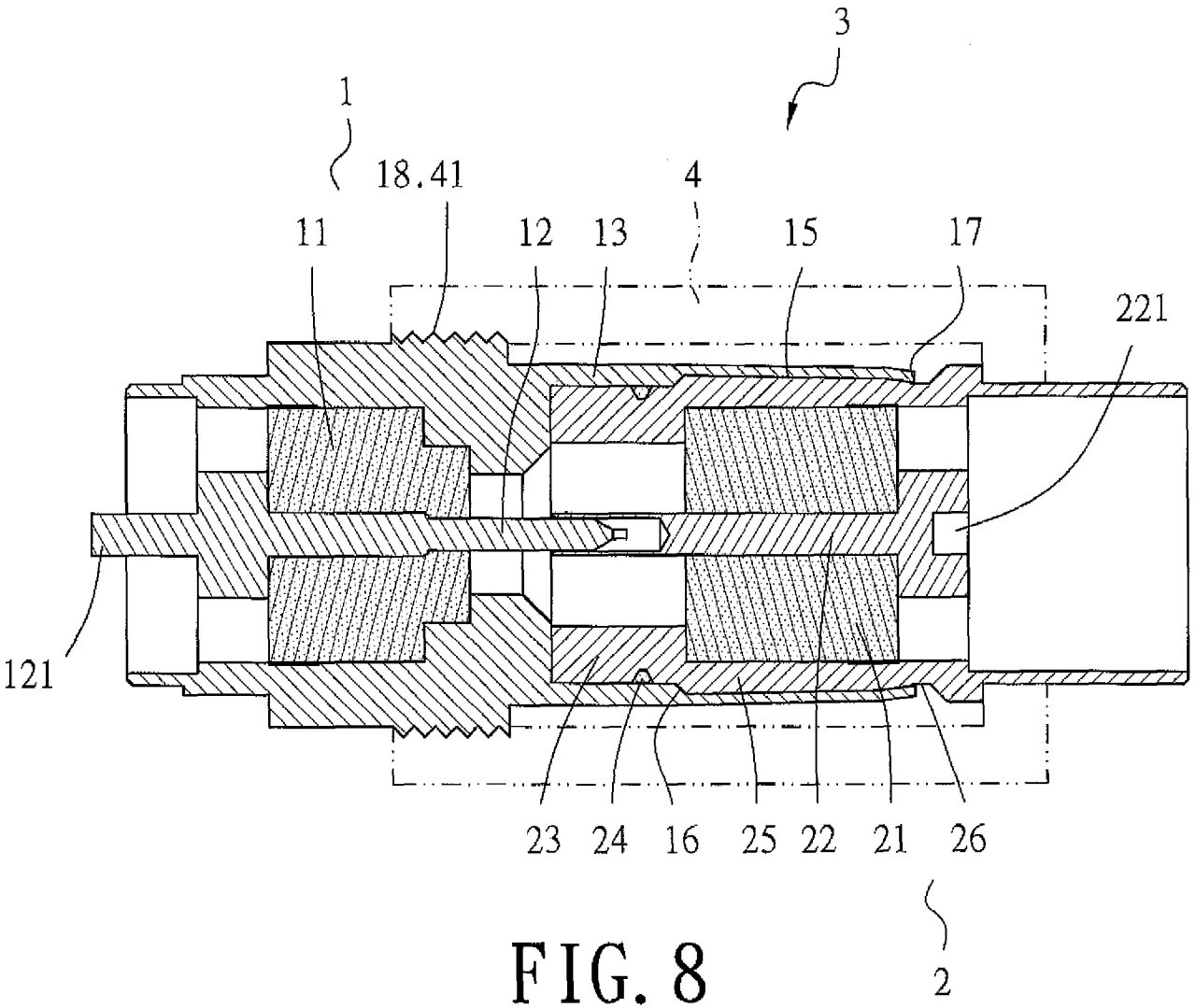
FIG. 8 is a sectional view of the high-frequency connector assembly of the present invention, wherein the second connector combined with the nut is assembled to the first connector.

Additionally, as shown in FIG. 7, the second connector 2 may be combined outside with a nut 4 before assembly to the first connector 1. Thus, when the second connector 2 is assembled to the first connector 1, an inner threaded section 41 at an end of the nut 4 can be screwed with the threaded section 18 of the first connector 1 into an integral form, as shown in FIG. 8. Consequently, the nut 4 ensures the firmness of the high-frequency connector assembly 3 composed by the first and second connectors 1, 2 when the high-frequency connector assembly 3 is applied to thick cables or antennas or used in an environment where an external interfering force exists.

Furthermore, the pin 12 settled in the first connector 1 may be extended backward to form a protruding end 121, which has a form determined by specifications of a PC board it is to be connected so that the high-frequency connector assembly 3 can be connected and communicated to external PC boards or other devices. The pin holder 22 settled in the second connector 2 may be differently provided with a receiving hole 221 (or slit) for receiving a coaxial cable, wherein the receiving hole 221 (or slit) may be designed according to the coaxial cable it is to be connected.

Figure 9:
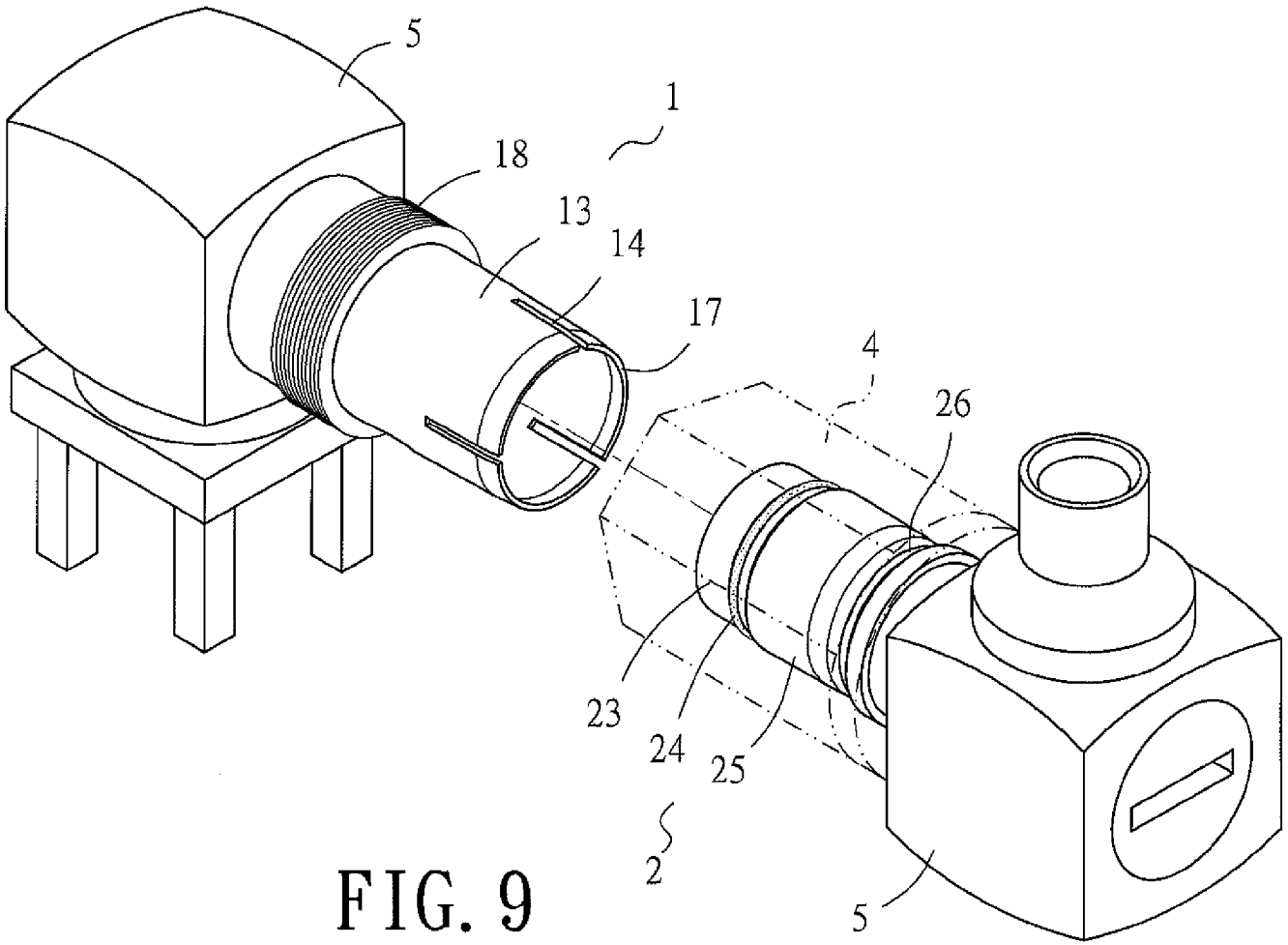
FIG. 9 is a schematic drawing showing the high-frequency connector assembly of the present invention, wherein the connectors are combined with an adapter, respectively.
Figure 10:
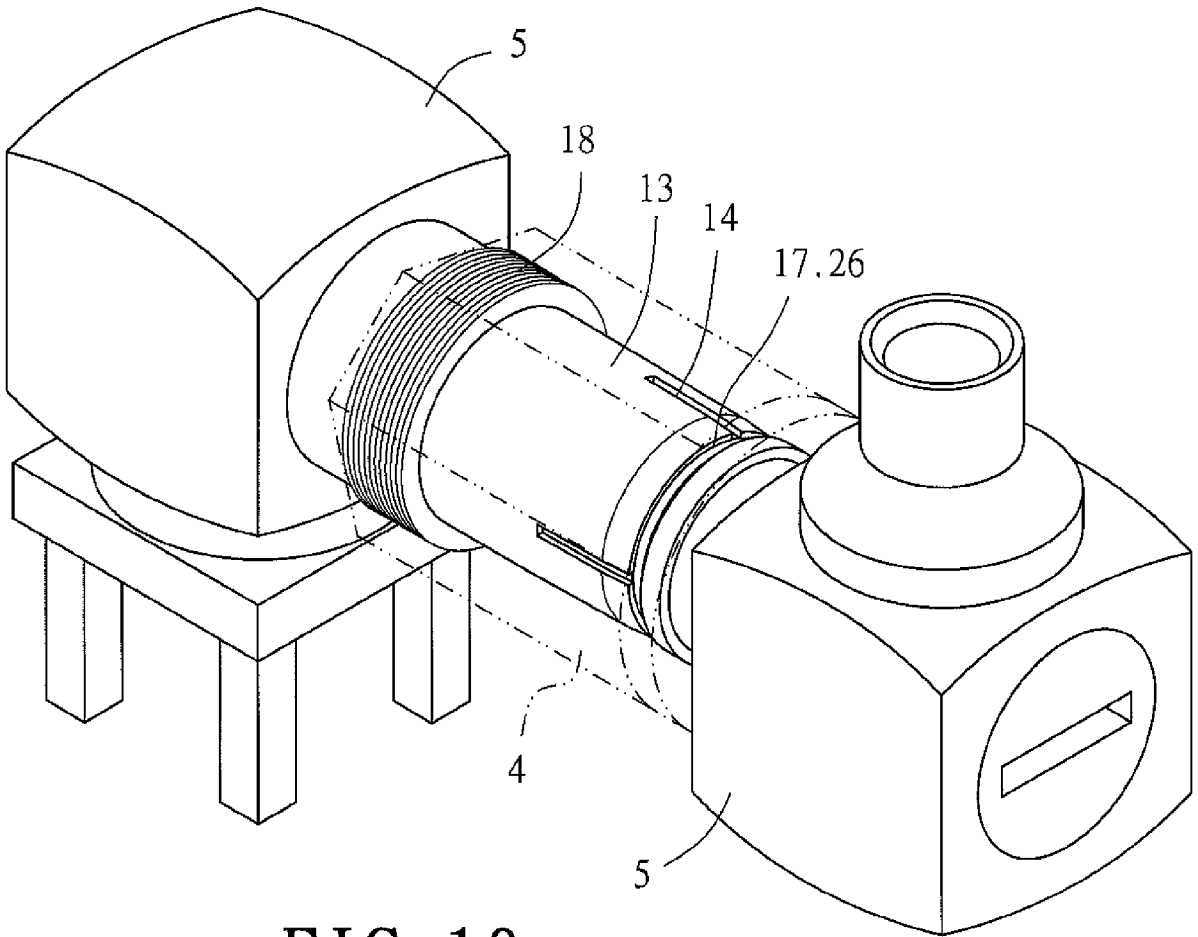
FIG. 10 depicts that the connectors combined with the adapters of the present invention are assembled into a high-frequency connector assembly.

Moreover, each of the first and second connectors 1, 2 may be further combined with an adapter 5 (as shown in FIG. 9) so that when the first and second connectors 1, 2 are assembled into the high-frequency connector assembly 3 (as shown in FIG. 10), such constructed high-frequency connector assembly 3 can be attached with other external components as needed.

Figure 11:
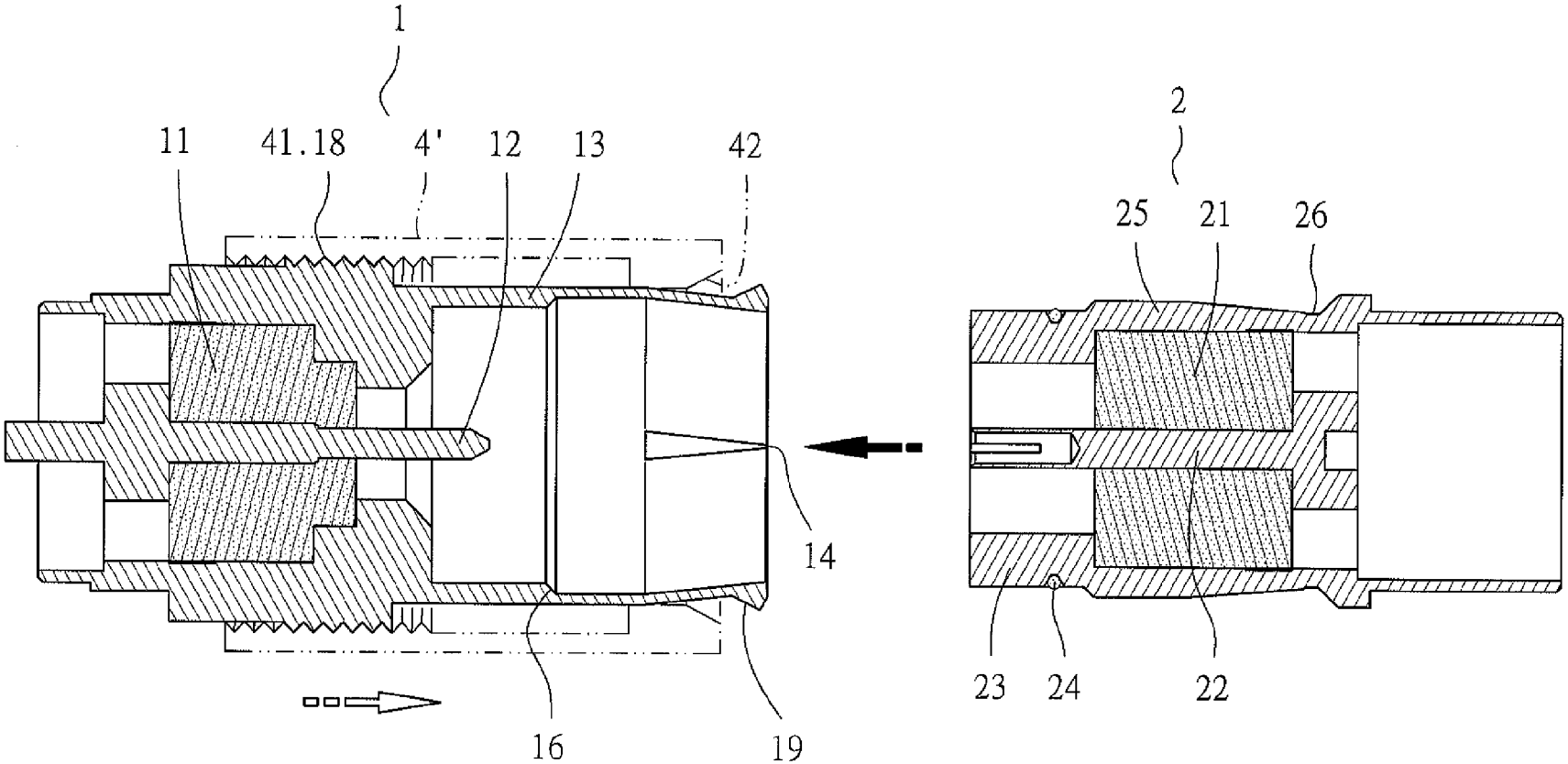
FIG. 11 is a schematic drawing showing that the first connector combined with a nut are going to be assembled to the second connector according to another embodiment of the present invention.
Figure 12A:
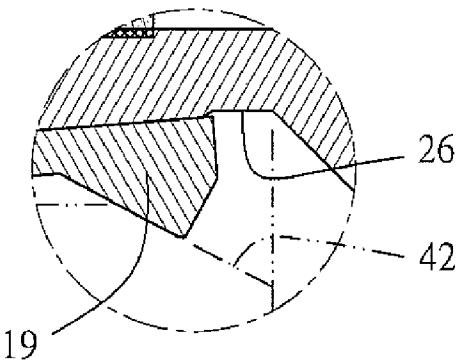
FIG. 12A is an enlarged, sectional view of the encircled area A of the high-frequency connector assembly of FIG. 12.
Figure 12:
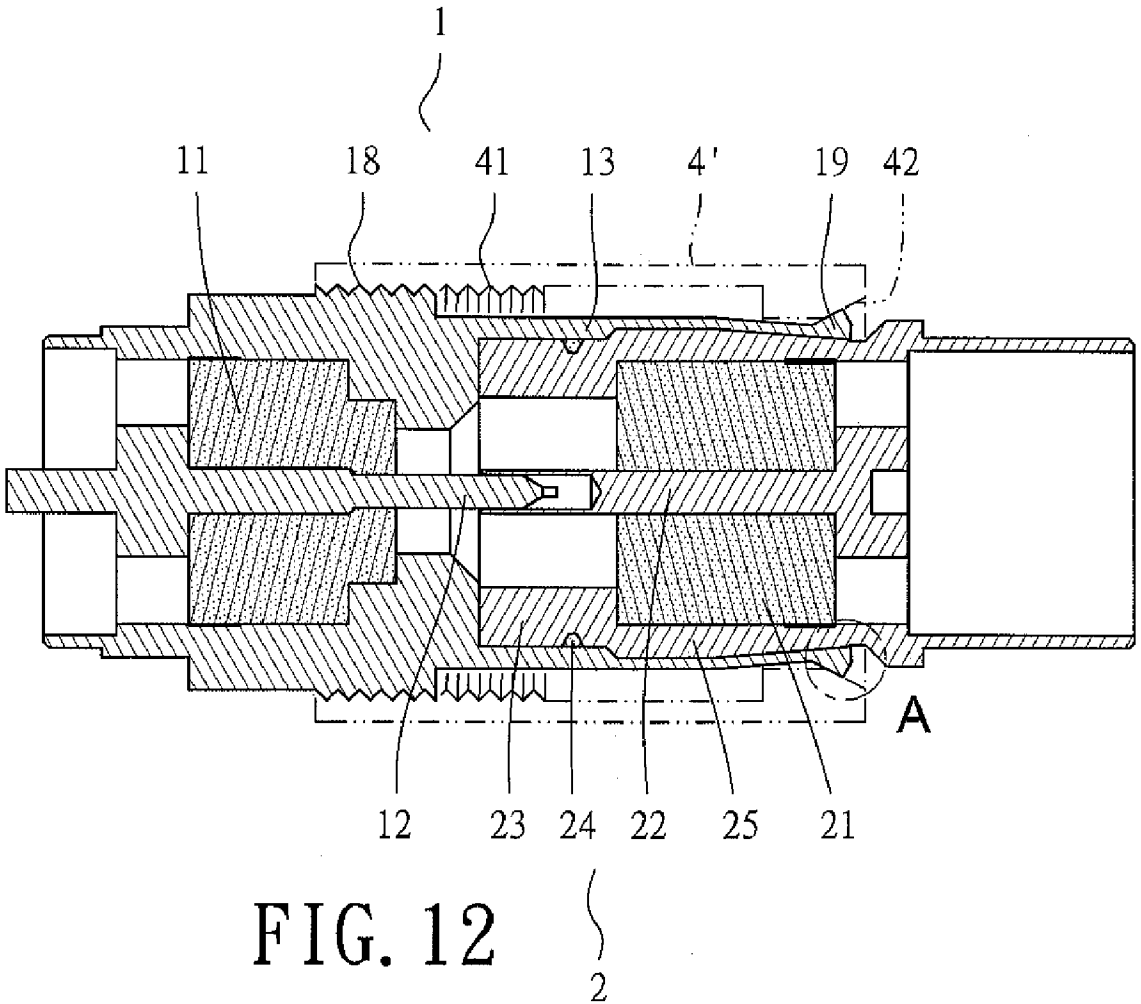
FIG. 12 is a schematic drawing showing the first connector combined with the nut assembled to the second connector according to the latter embodiment of the present invention.

According to another embodiment of the present invention as illustrated in FIG. 11, a normally contracted flexible raised annulation 19 is formed at the end of the receiving periphery 13 of the first connector 1 for pressingly abutting against and thereby being retained in the annular groove 26 defined between the two slopes at the rear end of the expanded section 25 on the second connector 2 (as shown in FIG. 12). In addition, a nut 4' having the inner threaded section 41 can be screwed onto the threaded section 18 of the first connector 1 toward the second connector 2 so that a slanted rim 42 formed at an opening of the nut 4' can pressingly abut against the flexible raised annulation 19 of the first connector 1. As a result, the flexible raised annulation 19 and the annular groove 26 defined between the two slopes on the second connector 2 can be further engaged with and positioned with respect to each other (as shown in FIG. 12A).

When used in an application under vibrational operating conditions, such as a moving car, an amplifier of a television, a mobile communication device, or an outdoor access point in a stormy day, the disclosed high-frequency connector assembly composed of the first and second connectors facilitates averting instable signals that easily happen in the occasions where the conventional connectors are used. The high-frequency connector assembly of the present invention is also applicable to mass-manufactured high-definition televisions and high-power amplifiers to enhance transmission efficiency in such products.

What is claimed is:

1. A high-frequency connector assembly comprising:

a first connector;

a second connector;

a conductive pin in the first connector, wherein the first connector is formed with at least one slit at a receiving periphery thereof for allowing the second connector having a connecting section inlaid with an O-ring to be inserted therein;

at least one contracted edge having a slope at a single, non parallel angle to a radial plane at an end of the receiving periphery of the first connector; and an annular groove having at least two slopes each at a single, non parallel angle to a radial plane provided on the second connector, with the at least two slopes of the annular groove corresponding to the slope of the at least one contracted edge, wherein when the first and second connector is fittingly received by a pin holder in the second connector.

2. The high-frequency connector assembly of claim 1, further comprising a nut threadably received on the first connector and rotatably mounted on the second connector.

3. The high-frequency connector assembly of claim 1, further comprising an adapter combined with one end of each of the first connector and the second connector.

4. The high-frequency connector assembly of claim 1, wherein each of the first and second connectors is formed inside with an anti-slip annular section adjacent to an insulator settled therein for securing the insulator from slipping, with the anti-slip annular section defined by inner threads formed along a positive direction and a negative direction.

5. A high-frequency connector assembly comprising:

a first connector;

a second connector;

a conductive pin in the first connector, wherein the first connector is formed with at least one slit at a receiving periphery thereof wherein the second connector has a connecting section inlaid with an O-ring to be inserted in the receiving periphery;

at least one contracted edge having a slope at an end of the receiving periphery of the first connector for pressingly abutting against an annular groove having at least two slopes provided on the second connector, wherein when the first and second connectors are assembled, the pin in the first connector is fittingly received by a pin holder in the second connector, wherein a normally contracted flexible raised annulation is formed at an end of the receiving periphery of the first connector for pressingly abutting against and thereby being retained in the annular groove between the at least two slopes at a rear end of an expanded section on the second connector; and a nut having an inner threaded section screwed onto a threaded section of the first connector toward the second connector, wherein a slanted rim formed at an opening of the nut pressingly abuts against the flexible raised annulation of the first connector and in turn the flexible raised annulation and the annular groove between the at least two slopes on the second connector are further engaged with and positioned with respect to each other.

6. The high-frequency connector assembly of claim 5, further comprising an adapter combined with one end of each of the first connector and the second connector.

7. The high-frequency connector assembly of claim 5, wherein each of the first and second connectors is formed inside with an anti-slip annular section adjacent to an insulator settled therein for securing the insulator from slipping, with the anti-slip annular section defined by inner threads formed along a positive direction and a negative direction.

* * * * *